US006049322A

United States Patent [19]

Yoshikawa et al.

[11] Patent Number: 6,049,322

[45] Date of Patent: Apr. 11, 2000

[54] MEMORY CONTROLLER FOR LIQUID CRYSTAL DISPLAY PANEL

[75] Inventors: Hiroshi Yoshikawa, Sagamihara; Hiroshi Yamashita, Fujisawa; Satoru Nishi, Zama, all of Japan

[73] Assignee: International Business Machines Corporation, Armonk, N.Y.

[21] Appl. No.: 08/682,988

[22] Filed: Jul. 16, 1996

[30] Foreign Application Priority Data

Jul. 20, 1995 [JP] Japan ..... 7-183686

[51] Int. Cl.[7] ..... G09G 3/36

[52] U.S. Cl. ..... 345/103; 345/99

[58] Field of Search ..... 345/103, 98, 100, 345/104, 99, 87, 84, 55, 515, 508, 202, 203, 90, 127, 88, 153, 131; 348/459, 441, 790, 571, 792, 793

[56] References Cited

U.S. PATENT DOCUMENTS

| | | | |
|---|---|---|---|
| 4,908,710 | 3/1990 | Wakai et al. | 345/103 |
| 4,985,698 | 1/1991 | Mano et al. | 345/103 |
| 5,168,270 | 12/1992 | Masumori et al. | 345/100 |
| 5,192,945 | 3/1993 | Kusada | 345/100 |
| 5,218,274 | 6/1993 | Zenda | 345/27 |
| 5,227,882 | 7/1993 | Kato | 358/160 |
| 5,488,389 | 1/1996 | Nakanishi et al. | 345/131 |
| 5,537,128 | 7/1996 | Keene et al. | 345/98 |
| 5,574,506 | 11/1996 | Rhodes | 348/459 |
| 5,710,604 | 1/1998 | Hodson et al. | 345/203 |
| 5,764,212 | 6/1998 | Nishitani et al. | 345/98 |
| 5,844,534 | 12/1998 | Okumura et al. | 345/103 |

FOREIGN PATENT DOCUMENTS

| | | |
|---|---|---|
| 0368572A3 | 5/1990 | European Pat. Off. . |
| 0457329A2 | 11/1991 | European Pat. Off. . |
| 0631270A2 | 12/1994 | European Pat. Off. . |
| 097-331981 | 11/1992 | Japan . |
| 07005850 | 1/1995 | Japan . |

OTHER PUBLICATIONS

IBM Technical Disclosure Bulletin vol. 38 No. 02 Feb. 1995 pp. 47–48.

*Primary Examiner*—Chanh Nguyen
*Attorney, Agent, or Firm*—Scully, Scott, Murphy & Presser; Jay P. Sbrollini, Esq.

[57] ABSTRACT

To reduce both frequency of the source driver and the capacity of memory used for this purpose. An apparatus for supplying data to a plurality of source drivers classified into a plurality of groups each of the source drivers driving a part of a LCD panel, comprising: a plurality of memory blocks, each block supplying data to one of the groups of the source driver and allowing itself to be read out and be written into simultaneously; control circuits for switching the memory blocks to be written when data of pixels drawn by one source driver when one line in the LCD panel is drawn written from the frame buffer into one memory block; and wherein while writing data into the memory block, the written data is read from the memory block at a lower speed than the writing, simultaneously.

13 Claims, 2 Drawing Sheets

MEMORY CONTROLLER FOR LIQUID CRYSTAL DISPLAY PANEL

BACKGROUND OF THE INVENTION

1. Technical Field

The present invention relates to a liquid crystal display apparatus, and in particular, to a method and device for supplying data to a data driver for a liquid crystal display panel.

2. Prior Art

The resolution of the display region of a liquid crystal display apparatus has recently been increasing; compared to conventional video graphic arrays (VGA) that have allowed display with 640×480 pixels, super VGAs (SVGAs) or extended graphic arrays (XGAs) allow display with 800×600 or 1024×768 pixels. With such a high resolution display, a source driver for supplying data to each pixel has a large operation frequency or is very expensive, or a new source driver must be developed. A higher operation frequency also prevents EMC regulations from being met. Furthermore, since an increase in resolution requires the size of the display region to be increased, the length of a signal transmission path and the impedance are accordingly increased, thereby preventing accurate signals from being transmitted at a high speed.

Attempts have been made to reduce the operation frequency of the source driver. For example, Japanese Patent Unexamined Published Application No. 5-100632 discloses a method for writing a data signal to four memories and then supplying the data from these memories to four source drivers. Since four source drivers drive a single liquid crystal display panel, the operation frequency of a single source driver is one-fourth of a conventional source driver. The capacity of each of these memories, however, must be twice the number of those pixels for which a source driver is responsible when it drives a single line. That is, a single memory stores data corresponding to those pixels contained in a single line for which the source driver is responsible. This data is subsequently read from the memory, while the data in the next line is written to that memory. A similar method is described in Japanese Patent Unexamined Published Application No. 5-181431.

Japanese Patent Unexamined Published Application No. 5-232898 also describes a method for providing four memories for two data drive circuits and using a switch to switch these memories to obtain similar effects.

Although the above conventional techniques indeed enable the operation frequency of the source driver to be reduced, the resultant increase in the number of source drivers may require the total capacities of the memories to be increased, or the control circuit may be complicated due to the use of the switch in the case of the method described in Japanese Patent Unexamined Published Application No. 5-232898.

SUMMARY OF THE INVENTION

It is thus an object of this invention to reduce the operation frequency of source drivers using memories of small capacities.

It is another object of this invention to reduce the operation frequency of source drivers using a simple circuit.

To achieve the above objects, this invention provides an apparatus for supplying data to a plurality of source of drivers classified into a plurality of groups, each of said source drivers driving a part of a LCD panel, comprising: a plurality of memory blocks, each block supplying data to one of the groups of the source driver and allowing itself to be read out and be written into simultaneously; and control means for writing into each memory block data for the source drivers of which the memory block is in charge. This configuration enables the reduction of the total capacity of the memory blocks and the drive frequency of the source drivers.

Another aspect of this invention is an apparatus for supplying data to a plurality of source drivers classified into a plurality of groups, each of the source drivers driving a part of a LCD panel, comprising: a plurality of memory blocks, each block supplying data to one of the groups of the source driver and allowing itself to be read out and be written into simultaneously; control means for switching the memory blocks to be written when data of pixels drawn by one source driver when one line in the LCD panel is drawn is written from the frame buffer into one memory block; and wherein while writing data into the memory block, the written data is read from the memory block at a lower speed than the writing, simultaneously. This configuration not only produces the above effects but also requires no changes to the structure of a computer system connected to the liquid crystal display apparatus.

In addition, if each number of the above groups and the memory blocks is n, a capacity of each memory block is (n−1)/n or less of a number of pixels of which one source driver is in charge when driving a single line, and a reading speed may be 1/N or more of the writing speed.

The (n) may be 2. In this case, the total memory capacity corresponds to a single source driver, and a single memory block corresponds to half the source driver.

The memory block may be a FIFO memory, but may be anything as long as it allows itself to be read out and be written into simultaneously.

Source drivers for a liquid crystal display apparatus are classified into a plurality of sets. A plurality of memory blocks are provided for each of these sets of source drivers. Data corresponding to those pixels for which a source driver is responsible when it drives a single line is written to a single memory block, and the written data is then immediately read from the memory block and supplied to the source driver. Once the data has been written to the single memory block, the writing is switched to another memory block, the above operation is repeated. The reading, however, is carried out at a lower speed than the writing so that while data is being written to a memory block, all of the data that has been written will have been supplied to the source driver.

BRIEF DESCRIPTION OF THE DRAWINGS

Preferred embodiments of the present invention will now be described, by way of example only, with reference to the accompanying drawings, in which.

DETAILED DESCRIPTION OF THE DRAWINGS

Preferred Embodiments of the Invention

Figure 1:
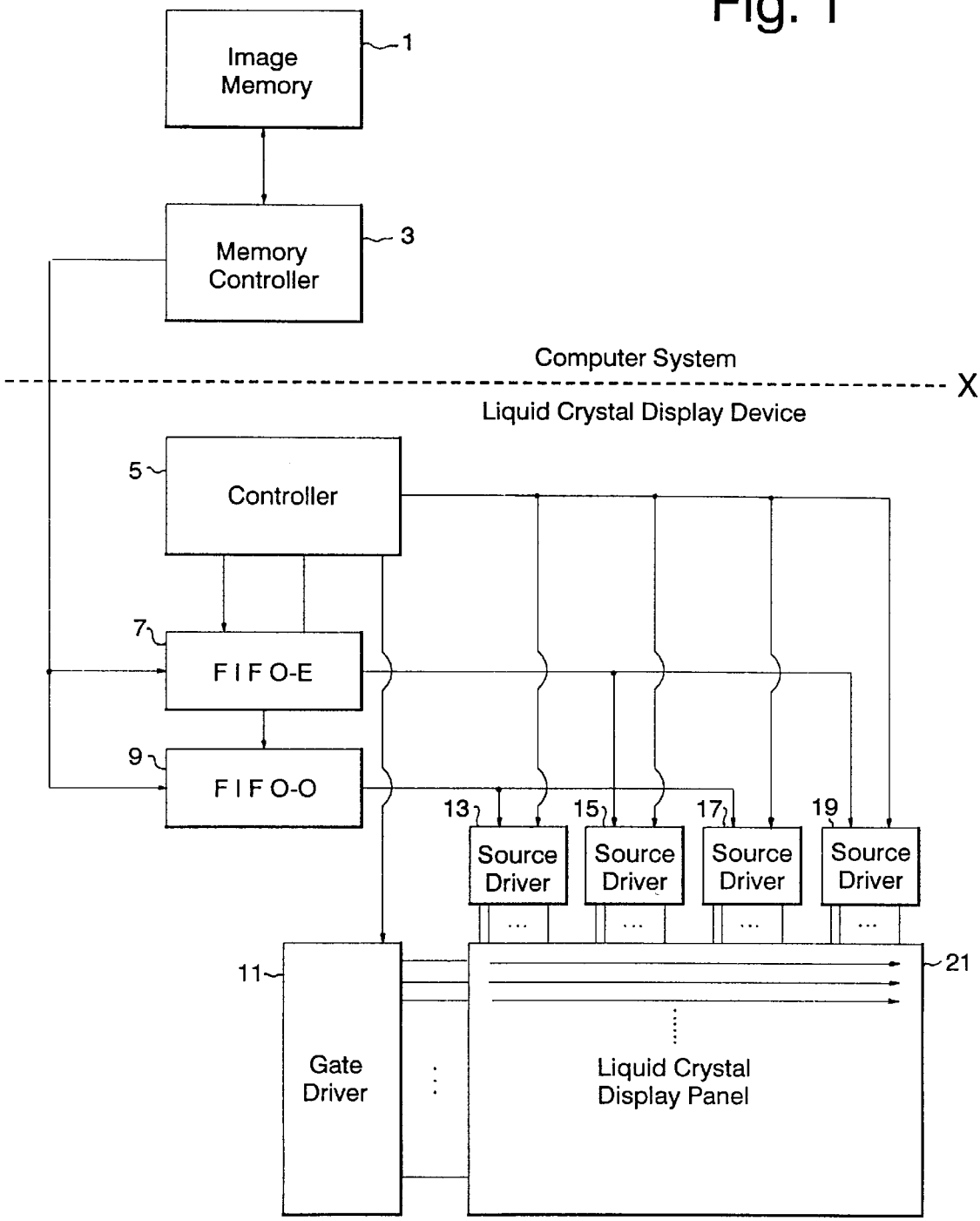
FIG. 1 is a block diagram showing an apparatus according to this invention.

FIG. 1 shows one embodiment of this invention. An image memory 1 stores data to be displayed in a digital form, and is connected to a memory control part 3. The memory control part 3 reads data stored in the image memory 1 in the order that the data is displayed on a liquid crystal display panel 21, and is connected to a FIFO-E7 and a FIFO-O9. The order of display refers to the direction from the left to the right end of the panel as shown by the arrow in the liquid crystal display panel 21. The image memory 1 and the memory control part 3 are contained within a computer system. The FIFO-E7 and FIFO-O9 temporarily store data read by the memory control part 3, and are contained in a liquid crystal display apparatus. The FIFO-E7 is connected to source drivers 15, 19, and is controlled under a control part 5. FIFO-O9 is connected to source drivers 13, 17, and is controlled under a control section 5. The control section 5 controls the source drivers 13, 15, 17, and 19 and a gate driver 11. The source drivers 13, 15, 17, and 19 each drive one fourth of the liquid crystal display panel 21.

The operation of this apparatus is described below. As described above, the memory control part 3 reads data stored in the image memory 1 in the order described above. The control part 5 enables writes to the FIFO-O9, and data for those pixels for which a source driver is responsible when it drives a single line is written to the FIFO-O9. First, the data for the source driver 13 is written to the FIFO-O9. The control part 5, however, simultaneously enables reads from the FIFO-O9 to start reading the written data therefrom. The control part 5 uses a control line to cause the source driver 13 to receive the data. Once the write to the FIFO-O9 has been finished, the control part 5 stops enabling writes to the FIFO-O9, and then enables writes to the FIFO-E7. The data for the source driver 15 is written to the FIFO-E7. The control part 5 also simultaneously enables reads from the FIFO-E7 to start reading the written data therefrom. The control part 5 uses the control line to cause the source driver 15 to receive the data.

The control part 5 subsequently enables writes to the FIFO-O9 to enable the data for the source driver 17 to be written to the FIFO-O9. It simultaneously enables reads from the FIFO-O9 to read the written data therefrom. The control part 5 also uses the control line to cause the source driver 17 to receive the data. Once the write to the FIFO-O9 has been finished, the control part 5 stops enabling writes to the FIFO-O9, and then enables writes to the FIFO-E7. The data for the source driver 19 is then written to the FIFO-E7. The control part 5 also simultaneously enables reads from the FIFO-E7 to start reading the written data therefrom. It uses the control line to cause the source driver 19 to receive the data. The same operation is continuously repeated.

Each source driver converts digital signals into analog signals, and outputs the signals to a source line to which its output is directed. The gate driver 11 activates a gate line with an appropriate timing so as to drive the liquid crystal in the liquid crystal display panel using the analog signals output to the source line.

Figure 2A:
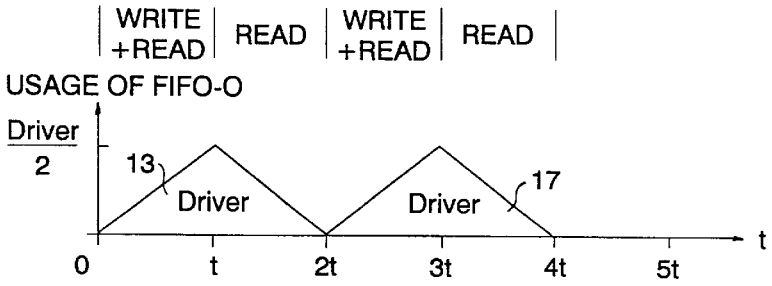
FIG. 2 is a chart describing the operation of a FIFO-O9 and a FIFO-E7.
Figure 2B:
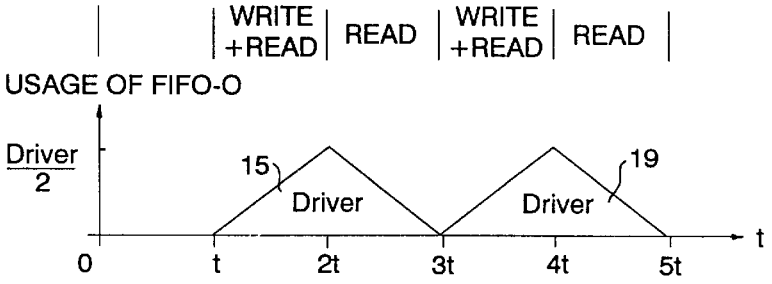

The required capacities of FIFOs can thus be reduced because reads from the FIFO-O and FIFO-E are finished while a write to another FIFO is being executed. This is shown in FIG. 2. It is assumed here that the speed at which data is written to a FIFO is twice the speed at which data is read from a FIFO.

FIG. 2(*a*) shows writes to and reads from the FIFO-O9. Although a write to the FIFO-O9 and a read from the FIFO-O9 are simultaneously carried out, the amount of memory consumed increases over the period of time (t) within the period of time 2t during which the data for the source driver 13 is processed because the writing speed is twice the reading speed. Since the read and the write are executed at the same time, however, the required memory capacity is reduced to half compared to the case in which no read is executed. Between points of time (t) and 2t, the data stored in the FIFO-O9 is read to reduce to zero the amount of memory used in the FIFO-O9.

FIG. 2(*b*) shows writes to and reads from the FIFO-E7. Between points of time (t) and 2t, a write to the FIFO-E7 and a read therefrom are executed simultaneously, and the writing speed is twice the reading speed. Thus, during this period of time when the data for the driver 15 is processed, the amount of memory used in the FIFO-E7 increases. Similarly, the memory capacity used is only half the amount of data corresponding to those pixels for which the driver is responsible when it drives a single line. Between points of time 2t and 3t, only reads from the FIFO-E7 are carried out to reduce to zero the amount of memory used in the FIFO-E7.

Referencing FIG. 2(*a*) again, the data for the driver 17 is written and read between points of time 2t and 3t. Between points of time 3t and 4t, the data written to the FIFO-O9 is read out.

Returning to FIG. 2(*b*), the data for the driver 19 is written and read between points of time 3t and 4t. Between points of time 4t and 5t, the data written to the FIFO-O9 is read out.

This configuration enables a single line of data to be written to each source driver at half the maximum writing speed. Although this writing speed can be somewhat increased, the operating frequency of the source driver is preferably as low as possible, and this apparatus enables the operating speed of the source driver to be reduced. Even in the case of two FIFOs, the required memory capacity is equal to only the amount of data for those pixels for which a single driver is responsible when it drives a single line, thereby enabling costs to be reduced.

Figure 3A:
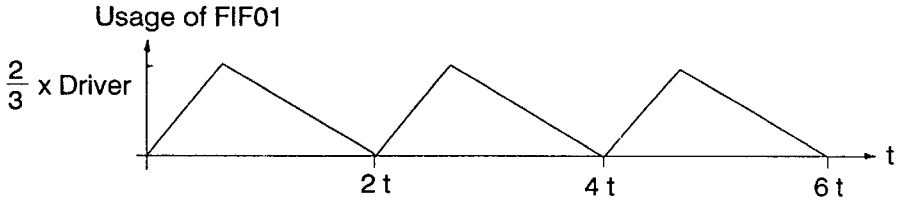
FIG. 3 is a chart describing the amount of memory consumed when three FIFOs are used.
Figure 3B:
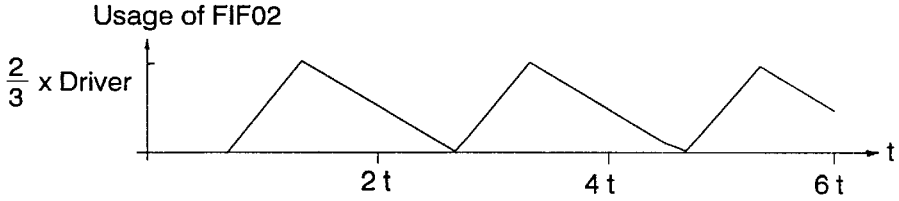
Figure 3C:
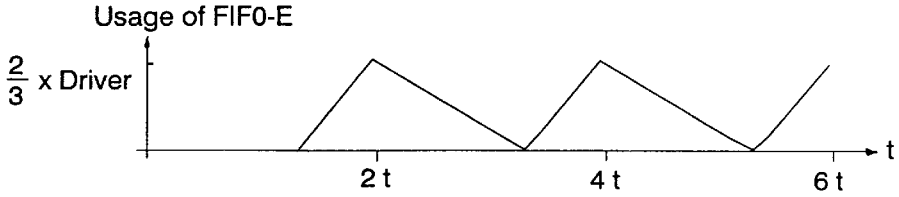

Although this invention has been described in conjunction with the case of two FIFOs, it is also applicable to three or more FIFOs. For example, the use of three FIFOs provides a reading speed that is one-third of the maximum writing speed. The total memory capacity of the FIFOs, however, is twice the amount of data for those pixels for which the driver is responsible when it drives a single line (two-thirds of that amount for a single FIFO). Such a memory usage is shown in FIG. 3.

As described above, by writing data to a FIFO and then immediately reading the written data therefrom, both the memory capacity of the FIFO and the drive frequency of a source driver can be reduced. If, however, the drive frequency of the source driver is not significantly reduced, this invention can be implemented with a smaller memory capacity. For example, in FIG. 2, if the reading speed is higher than half the writing speed, the peak of the amount of memory used in a FIFO becomes lower and this amount decreases to zero before point of time 2t.

In addition, although this implementation has been described in conjunction with the use of a single bus for inputting data to each FIFO and the write to the FIFO-O9 and the write to the FIFO-E7 are thus executed at different points of time, different pieces of data for respective FIFOs may be supplied to different buses.

FIG. 1 separately shows the configurations of the computer system and the liquid crystal display apparatus, this boundary between the computer system and the liquid crystal display apparatus has arbitrarily been set, and it can be assumed that there is no boundary therebetween. That is, it can be assumed that all the components reside in the computer system.

As described above, the operating frequency of a source driver could be reduced using a small memory capacity.

The operating frequency of a source driver could also be reduced using a simple control circuit.

While the invention has been particularly shown and described with respect to (a) preferred embodiment(s) thereof, it will be understood by those skilled in the art that the foregoing and other changes in form and details may be made therein without departing from the spirit and scope of the invention.

Having thus described our invention, what we claim as new, and desire to secure by Letters Patent is:

1. An apparatus for supplying data to a plurality of source drivers classified into a plurality of groups, each of said source drivers driving a part of a LCD panel, comprising:

a plurality of memory blocks, each block supplying data to one of said groups of said source driver and allowing itself to be simultaneously read out at a reading speed and written into at a writing speed, wherein the reading speed is slower than the writing speed; and control means for writing into each memory block data for said source drivers of which the memory block is in charge.

2. An apparatus according to claim 1, wherein said memory block is a FIFO memory.

3. An apparatus for supplying data to a plurality of source drivers classified into a plurality of groups, each of said source drivers driving a part of a LCD panel, comprising:

a plurality of memory blocks, each block supplying data to one of said groups of said source driver and allowing itself to be read out and be written to simultaneously;

control means for switching said memory blocks to be written when data of pixels drawn by one said source driver when one line in the LCD panel is drawn is written from the frame buffer into one said memory block; and wherein while writing data into said memory block, the written data is read from said memory block at a lower speed than the writing, simultaneously.

4. An apparatus according to claim 3, wherein each number of the groups and said memory blocks is n, a capacity of each said memory block is (n−1)/n or less of a number of pixels of which one said source driver is in charge when driving a single line, and a reading speed is 1/N or more of the writing speed.

5. An apparatus according to claim 4, wherein said n is 2.

6. An apparatus according to claim 3, wherein said memory block is a FIFO memory.

7. An apparatus for supplying data to a plurality of source drivers classified into a plurality of groups, each of said source drivers driving a part of a LCD panel, comprising:

a plurality of memory blocks, each block supplying data to one of said groups of said source driver and allowing itself to be read out and be written into simultaneously; and control means for switching said memory blocks to be written when data of pixels drawn by one said source driver when one line in the LCD panel is drawn is written from the frame buffer into one said memory block, and controlling so as to read a written data from said memory block at a lower speed than a writing speed while writing the data into said memory block simultaneously.

8. An apparatus according to claim 1, wherein each number of the groups and said memory blocks is n, a capacity of each said memory block is (n−1)/n or less of a number of pixels of which one said source driver is in charge when driving a single line, and a reading speed is 1/N or more of the writing speed.

9. An apparatus according to claim 8, wherein said n is 2.

10. An apparatus according to claim 7, wherein each number of the groups and said memory blocks is n, a capacity of each said memory block is (n−1)/n or less of a number of pixels of which one said source driver is in charge when driving a single line, and a reading speed is 1/N or more of the writing speed.

11. An apparatus according to claim 10, wherein said n is 2.

12. An apparatus according to claim 7, wherein said memory block is a FIFO memory.

13. A liquid crystal display apparatus, comprising:

an LCD panel;

a plurality of source drivers classified into a plurality of groups, each of said source drivers driving a part of the LCD panel; and a data supply device for supplying data to the LCD panel, having a plurality of memory blocks, each block supplying data to one of said groups of said source driver and allowing itself to be read out and be written into simultaneously; and control means for switching said memory blocks to be written when data of pixels drawn by one said source driver when one line in the LCD panel is drawn is written from the frame buffer into one said memory block, and controlling so as to read a written data from said memory block at a lower speed than a writing speed while writing the data into said memory block, simultaneously.

* * * * *

UNITED STATES PATENT AND TRADEMARK OFFICE

CERTIFICATE OF CORRECTION

PATENT NO. : 6,049,322
DATED : April 11, 2000
INVENTOR(S) : Hiroshi Yoshikawa, et al.

It is certified that error appears in the above-identified patent and that said Letters Patent is hereby corrected as shown below:

On The Title Page, [75] Inventors: "Sagamihara;"should read -- Sagamihara-Shi--

On The Title Page, [75] Inventors: "Fujisawa" should read--Fujisawa-Shi--

On The Title Page, [57] ABSTRACT: "control circuits" should read --control means--

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*